US006457684B1

(12) United States Patent
McKendry

(10) Patent No.: US 6,457,684 B1
(45) Date of Patent: Oct. 1, 2002

(54) SUPPORT SYSTEM FOR BANNERS

(76) Inventor: Anthony James McKendry, 33 Pinny Avenue, Lower Hutt (NZ)

( * ) Notice: Subject to any disclaimer, the term of this patent is extended or adjusted under 35 U.S.C. 154(b) by 0 days.

(21) Appl. No.: 09/485,920

(22) PCT Filed: Aug. 18, 1998

(86) PCT No.: PCT/NZ98/00123

§ 371 (c)(1),
(2), (4) Date: May 10, 2000

(87) PCT Pub. No.: WO99/09542

PCT Pub. Date: Feb. 25, 1999

(30) Foreign Application Priority Data

Aug. 19, 1997 (NZ) ..... 328588

(51) Int. Cl.[7] ..... A45D 19/04; G09F 17/00

(52) U.S. Cl. ..... 248/127; 248/159; 248/460; 40/603; 40/610

(58) Field of Search ..... 248/127, 176.1, 248/460, 153, 159, 160, 465.1; 40/603, 604, 606, 610; D20/10, 42, 43, 41, 21

(56) References Cited

U.S. PATENT DOCUMENTS

| | | | | | |
|---|---|---|---|---|---|
| 1,870,798 | A | * | 8/1932 | Einson | 40/603 |
| 2,005,134 | A | | 6/1935 | Emley | 40/135 |
| 2,160,457 | A | * | 5/1939 | Housman et al. | 40/603 |
| 2,419,181 | A | * | 4/1947 | Watson | 40/603 |

(List continued on next page.)

FOREIGN PATENT DOCUMENTS

| | | | | |
|---|---|---|---|---|
| AU | 1141195 | | 8/1995 | G09F/15/00 |
| DE | 19822174 | A1 * | 11/1999 | |
| FR | 2754929 | | 4/1998 | G09F/1/10 |
| JP | 10319889 | A * | 12/1998 | |
| JP | 2000206913 | A * | 7/2000 | |
| WO | 9311521 | | 6/1993 | G09F/1/06 |
| WO | 9714132 | | 4/1997 | G09F/15/00 |
| WO | WO-99/59122 | * | 11/1999 | |
| WO | WO-01/31618 | A1 * | 5/2001 | |

OTHER PUBLICATIONS

Internet printout—Penguin Banner Stand—Date unknown.*

Internet printout—Downing Displays—Date unknown.*

Internet printout—C1/C2 Banner Displays—Date unknown.*

Internet printout—Arch Banner Stand—Date unknown.*

Pi'Com, Chrono Expo Brochure, Date Unknown.

Trimco Brochure, Date Unknown.

Pingu Brochure, Date Unknown.

Xtra Lite Display Systems, Xtra Lite Brochure, 1996.

*Primary Examiner*—Leslie A. Braun
*Assistant Examiner*—Naschica S. Morrison
(74) *Attorney, Agent, or Firm*—Volpe and Koenig, P.C.

(57) ABSTRACT

A support stand is provided for the presentation of banners in a free standing and substantially vertical orientation, wherein the stand comprises a base portion of preferably two spaced apart elongate support members joined by a connecting member which maintains the support members in a spaced apart relationship, each support member having means for accepting the end of a flexible support rod, each accepting means being spaced from one end of the respective support member, means for attaching an elongate banner to one end of each support member so that it extends substantially vertically therefrom, said banner being held in said vertical orientation by two flexible rods, one end of each rod engaging said accepting means, the other end of each rod being attached to a top edge of the banner, so that the rods are curved and in tension. The flexible support rods arc preferably composed of two or three interconnecting rods, and the connecting member is optionally fitted with suction cups. The support stand can provide for banners of varying length and width.

7 Claims, 2 Drawing Sheets

U.S. PATENT DOCUMENTS 2,956,287 A * 10/1960 Stanford ..... 4/144.2
4,700,498 A 10/1987 Perutz et al. ..... 40/603
D390,879 S * 2/1998 Justen et al. ..... D20/10
5,839,705 A * 11/1998 LaMotte ..... 248/165
5,960,572 A * 10/1999 DeVito ..... 40/593
5,983,545 A * 11/1999 Marco ..... 40/610
6,012,688 A * 1/2000 LaMotte ..... 248/165
D434,806 S * 12/2000 Justen et al. ..... D20/10
D434,807 S * 12/2000 Justen et al. ..... D20/10
6,332,284 B1 * 12/2001 Tafforeau ..... 160/135

* cited by examiner

SUPPORT SYSTEM FOR BANNERS

FIELD OF THE INVENTION

The invention relates to a freestanding support system for lightweight banner materials. In particular it relates to a freestanding support system which is readily portable, and is adapted to provide for banners of more than one height or width.

BACKGROUND OF THE INVENTION

It has been a common practise up until now, for display banners to be hung from a wall or ceiling. If they need to be independently hung in a self-supporting fashion, then free-standing solid metal frame units have been the only available support system.

The problem with the wall or ceiling hung unit is that it cannot be moved easily, and very often property is damaged during the installation process. The freestanding banner support systems currently in use are mainly of steel or a similar alloy and completely surround the banner. They are heavy and bulky to transport and detract from the banner's message by their 'obtrusive' presence.

An attempt has been made at overcoming this problem by way of a lightweight and movable bannerstand using a carbon fiber flexible rod system, where the supporting rods are crossed. However, this system has several drawbacks in that the 'crossover' rod design is complicated and fiddly to operate, only one height is available, and only one width is available per system. Furthermore the system is expensive as the carbon fiber rods with their interconnecting internal strings are very costly to produce and ultimately, retail to the end consumer. Finally, there is no way to secure the unit from moving when bumped.

There is a need for a support system for banners which is portable, unobtrusive and relatively inexpensive.

OBJECT

It is an object of the present invention is to provide an improved support system for banners, or at least to provide the public with a useful choice.

STATEMENT OF INVENTION

In a first aspect the invention provides a support stand for a banner comprising a base portion having accepting means for accepting at least one flexible support rod, means for attachment of an elongate banner to said base portion so that it extends substantially vertically therefrom, said banner being held in said vertical orientation by at least one flexible rod, one end of said rod engaging said accepting means, the other end of said rod being attached to a top edge of said banner attachment means so that said rod is curved and in tension.

According to another aspect of the invention there is provided a support stand for a banner comprising two spaced apart elongate support members joined by a connecting member which maintains the support members in a spaced apart relationship, each support member having means for accepting the end of a flexible support rod, each accepting means being spaced from one end of the respective support member, means for attaching an elongate banner to one end of each support member so that it extends substantially vertically therefrom, said banner being held in said vertical orientation by two flexible rods, one end of each rod engaging said accepting means, the other end of each rod being attached to a top edge of said banner attachment means, so that the rods are curved and in tension.

Preferably the flexible support rods are comprised of a plurality of interconnecting flexible rods. In the most preferred options the flexible support rods are comprised of either two or three interconnecting flexible rods.

Optionally the connecting member is provided with suction cups for securing the support system to the ground surface.

Preferably the accepting means is a tube adapted to receive an end of the said flexible rod.

Preferably the connecting member is secured to the support members by means of an angled tab at each end, adapted to fit into a receiving projection attached to each support member.

Preferably a banner is attached to the support system by means of upper and lower cross rods threaded through the banner at each end.

The flexible support rods are prepared from materials, such that, when the rods are not under tension, as in when they are not in use in supporting a banner, they revert to being substantially straight. Preferably the rods are produced from several composite materials, with fiber glass being a main component. However, it is envisaged as within the scope of this invention that the rods may be made from any suitable flexible material which bends readily under tension, but returns to being substantially straight when the tension is removed.

Preferably the support members and connecting member are prepared from lightweight metals which may be powder coated, although it is within the scope of the invention that any other suitable material may be used.

In another aspect of the invention there is provided a support stand for a banner comprising two spaced apart elongate support members joined by a connecting member which maintains the support members in a spaced apart relationship, each support member having means for accepting the end of a flexible support rod, each accepting means being spaced from one end of the respective support member, means for attaching an elongate banner to one end of each support member so that it extends substantially vertically therefrom, said banner being held in said vertical orientation by two flexible rods, one end of each rod engaging said accepting means, the other end of each rod being attached to a top edge of the banner attachment means, so that the rods are curved and in tension, wherein the support stand is disassembled into its component parts including two support members, a connecting member, a plurality of flexible rods and means for attachment of a banner.

Optionally the support system is provided with an accompanying storage bag into which the component parts can be readily fitted, and assembled on removal from the bag.

In yet a further aspect of the invention there is provided a method of supporting a banner in a free standing, substantially vertical orientation comprising attaching said banner to a support system comprising two spaced apart elongate support members joined by a connecting member which maintains the support members in a spaced apart relationship, each support member having means for accepting the end of a flexible support rod, each accepting means being spaced from one end of the respective support member, means for attaching an elongate banner to one end of each support member so that it extends substantially vertically therefrom, said banner being held in said vertical orientation by two flexible rods, one end of each rod engaging said accepting means, the other end of each rod being attached to a top edge of the banner attachment means so that the rods are curved and in tension.

The support system is adapted to accommodate banners of different heights and widths. Variable heights of banners may be accommodated by varying the lengths and numbers of interconnecting flexible rods used to support the banner. In a most preferred version of the invention two heights of banner are catered for, being 1.5 m when each flexible rod is comprised of two interconnecting rods, and a height of 2.15 m when each flexible rod is comprised of three interconnecting rods.

Banners of different widths can be accommodated as the support system is adapted to receive cross bars of varying width. Preferably the banner widths are between 60 cm and 100 cm.

BRIEF DESCRIPTION OF DRAWINGS

These and other aspects of the invention, which should be considered in all its novel aspects, will become apparent by way of the following description, which is given by way of example only, with reference to the accompanying drawings, in which.

DETAILED DESCRIPTION OF THE PREFERRED EMBODIMENT

Figure 1:
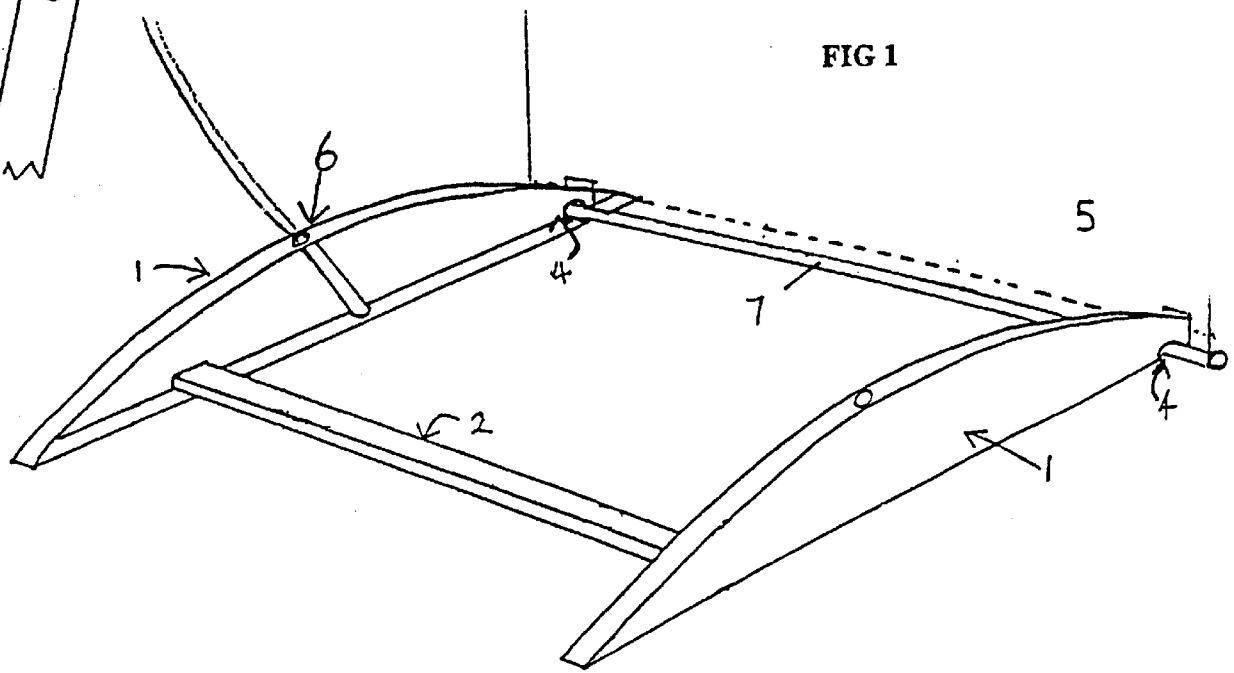
FIG. 1 is an isometric view of the base unit of the support system.
Figure 2:
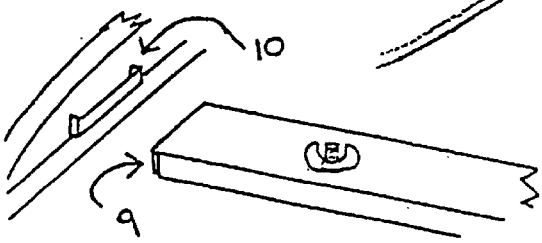
FIG. 2 is an isometric view of the attachment of the cross member to the support member.
Figure 3:
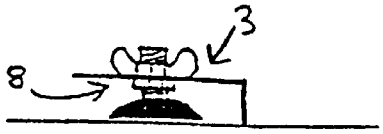
FIG. 3 is a side view of the connecting member and optional suction cup.
Figure 5:
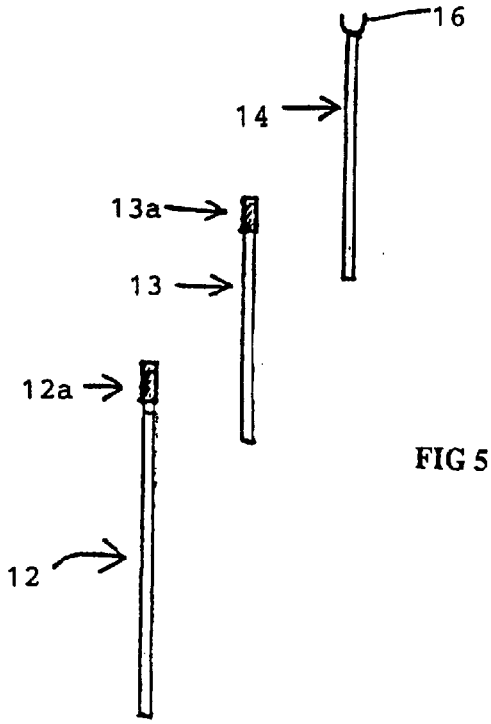
FIG. 5 is an exploded view of the interconnecting support rods.
Figure 4:
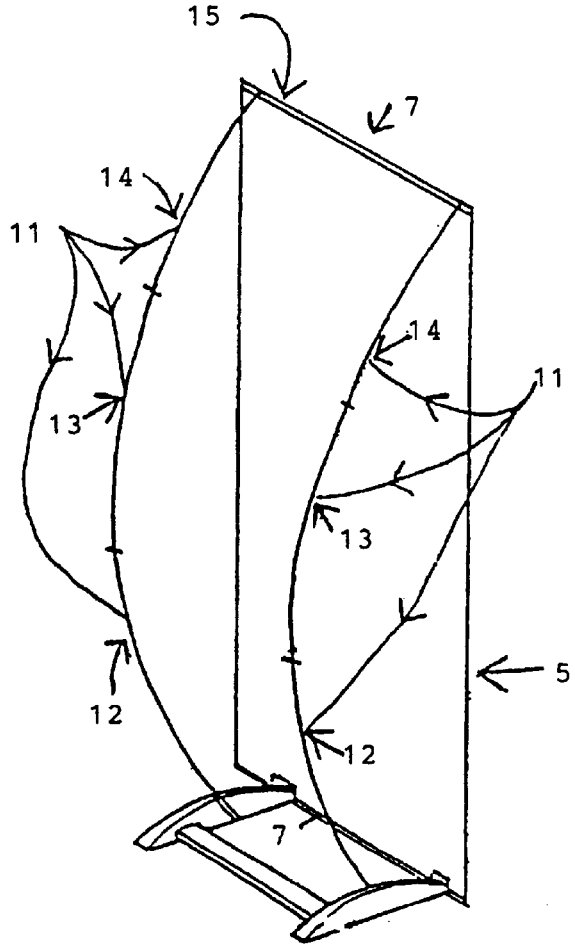
FIG. 4 is an isometric view of the assembled support stand and banner.

In a preferred embodiment of the invention the base unit of the support stand comprises the left and right support members (1) and the connecting member (2), which can be made of basic lightweight metals, then powder coated. The bottom of both support members has a semi-circular cut-away section (4) at the front end allowing for the lower banner rod (7), to be placed underneath. The rod, prior to this, has been inserted in a loop provided in the bottom of the banner (5). The bottom of both the left and right support members is flat with a gentle curved top rising to a maximum height around the center of its length. Adjacent to the center, on the inside edge of the curved portion of the support members is a small tube (6) acting as base receptacle for the flexible support rods. This tube is inclined at such a backward angle so as to create sprung tension in the flexible rods when connection is made to the top banner at cross rod (7).

The connecting member (2) provides both rigidity and support for both side support members, plus a platform for the suction cups if they are employed. These cups, when attached to a flat surface, assist in deterring the support system from moving. They are held in place by a wing nut (3) atop the connecting member, and a securing nut (8) underneath. At either end of the connecting member is an angled tab (9), which neatly slips into a flat shaped projection (10) attached to the left and right support members.

In total there are provided six interconnecting flexible rods (12), (13) and (14), and either two or three may be employed on each side to form the complete flexible support rod (11). The middle and top rods (13) and (14), are of equal length, whilst the lower rods (12), are slightly longer. The rod material is constructed of several composite materials, fibreglass being the main substance. A unidirectional pattern provides good flexibility and pretension when 'bent'. There is high tensile strength, and excellent 'memory' when the rods are returned to the straight position. The bottom flexible rod (12), has a sleeve at one end **(12*a*). The unsleeved end is inserted into the support members (1) by way of the tube (6). The sleeved end receives the unsleeved center rod (13). At the other end of the center rod is another sleeve (13*a*), which receives the top rod's (14) unsleeved end. At the end of the top rod is a curved cup-like shape (16) that is slipped under the top banner cross rod (7). By removing the center rod (13) and connecting the top rod (14) to the bottom rod (12),the support stand is adapted to provide for a banner of a different height. The invention, in The banner support cross rods (7) are of the same material as the support rods (11)** and come in differing lengths, depending on banner width requirements.

In the preferred method of assembly of the support stand the two support members (1), are connected by clipping the connecting member to them by means of the angled tab (9) and the projection (10). The banner cross rods (7) are then inserted into the sleeves provided at the upper and lower ends of the banner (5), and the lower banner cross rod is inserted into the semi-circular cut-away sections (4), on each support member (1). The required number of flexible rods are then joined to provide the flexible support rod (11), which is inserted into the support member by way of the tube (6) provided to receive it. The rod is then compressed so as to enable it to clip into the upper banner cross rod (7) by way of the hook (16).

The result is a constant pre-tensioning of the banner. Light pressure is constantly exerted on the banner. The support stand is thus virtually invisible from a front-on angle, and only slightly visible at other angles. This gives more emphasis to the image being promoted on the actual banner.

The whole assembly the forms a compact unit which is easily dismantled and packed away into a lightweight tote bag.

What is claimed is:

1. A support stand assembly for displaying a banner having upper and lower ends comprising:

an upper transverse rod and a lower transverse rod;

two flexible support rods;

a base including two elongate support members removably joined by a transverse connecting member to maintain the support members in a spaced apart relationship, each support member having female receiving means spaced from and inclined toward a first end of the support member to removably receive a first end of one flexible support rod, and means adjacent a second end of the support member for receiving an end of said lower traverse rod; and means for removably attaching a second end of each flexible support rod to said upper transverse rod;

such that when the upper and lower ends of the banner are attached to the upper and lower transverse rods, respectively, each end of the lower transverse rod is received in each said support member, each flexible support rod is attached to one of said support members and said upper transverse rod, the banner is displayed in a substantially upright orientation and the flexible support rods arc not in contact and are curved and under compression.

2. A support stand as claimed in claim 1 wherein each flexible support rod is comprised of a plurality of interconnecting flexible rods.

3. A support stand as claimed in claim 2 wherein each flexible support rod is comprised of either two or three interconnecting flexible rods.

4. A support stand as claimed in claim 1 wherein the transverse connecting member is provided with suction cups.

5. A support stand as claimed in claim 1 wherein the means to removably receive the first end of one flexible support rod is a tube adapted to receive one of the flexible support rods.

6. A support stand as claimed in claim 1 wherein the flexible support rods are straight when not in use in supporting said banner.

7. A method of supporting a banner in a free standing and substantially upright orientation comprising:

providing a banner;

providing support stand assembly components including: an upper transverse rod and a lower transverse rod;

two flexible support rods; and a base including two elongate support members removably joined by a transverse connecting member to maintain the support members in a spaced apart relationship, each support member having female receiving means spaced from and inclined toward a first end of the support member to removably receive a first end of one flexible support rod and means adjacent a second end of the support member for receiving an end of said lower traverse rod;

attaching said transverse connecting member to the support members;

attaching said upper transverse rod to the top of said banner;

attaching said lower transverse rod to the bottom of said banner;

inserting one of the ends of said lower transverse rod into each said receiving means adjacent the second ends of the support members;

inserting the first end of one of the flexible support rods into the female receiving means of one of the support members;

inserting the first end of the other of the flexible support rods into the female receiving means of the other of the support members; and attaching a second end of each flexible support rod to said upper transverse rod such that the flexible support rods are not in contact and are curved and under compression, whereby said banner is displayed in a substantially upright orientation under tension.

* * * * *